US007961171B2

(12) United States Patent
Miyasaka et al.

(10) Patent No.: US 7,961,171 B2
(45) Date of Patent: Jun. 14, 2011

(54) ELECTROOPTIC DEVICE AND ELECTRONIC APPARATUS

(75) Inventors: Mitsutoshi Miyasaka, Suwa (JP); Nobuhiko Kenmochi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 870 days.

(21) Appl. No.: 11/923,959

(22) Filed: Oct. 25, 2007

(65) Prior Publication Data

US 2008/0100566 A1 May 1, 2008

(30) Foreign Application Priority Data

Oct. 25, 2006 (JP) ..... 2006-289959
Aug. 20, 2007 (JP) ..... 2007-214123

(51) Int. Cl.
*G09G 3/36* (2006.01)

(52) U.S. Cl. ..... 345/104; 345/107; 345/175; 349/12

(58) Field of Classification Search ..... 345/175, 345/104, 107; 235/435
See application file for complete search history.

(56) References Cited

U.S. PATENT DOCUMENTS 6,297,862 B1 10/2001 Murade
6,747,638 B2 6/2004 Yamazaki et al.
7,158,201 B2 1/2007 Kim et al.
7,164,164 B2 1/2007 Nakamura et al.
7,525,523 B2 4/2009 Yamazaki et al.
7,746,294 B2 * 6/2010 Lee et al. ..... 345/30
2002/0105603 A1 8/2002 Yoo et al.
2004/0027327 A1 * 2/2004 LeCain et al. ..... 345/107
2006/0033729 A1 * 2/2006 Yoshida et al. ..... 345/207
2006/0097975 A1 5/2006 Lee et al.
2006/0119590 A1 * 6/2006 Park et al. ..... 345/175
2007/0252005 A1 * 11/2007 Konicek ..... 235/435
(Continued)

FOREIGN PATENT DOCUMENTS

EP 0685757 A 12/1995
(Continued)

*Primary Examiner* — Richard Hjerpe
*Assistant Examiner* — Sahlu Okebato
(74) *Attorney, Agent, or Firm* — AdvantEdge Law Group, LLC

(57) ABSTRACT

An electrooptic device having an image display period and an information gathering period includes a panel unit and a data processing unit. The panel unit includes a first substrate, a second substrate, an electrooptic material interposed between the first and second substrates, a plurality of first scan lines provided above the first substrate, a plurality of second scan lines provided above the first substrate and disposed in parallel to the first scan lines, a plurality of signal lines provided above the first substrate and intersecting the first scan lines and the second scan lines, and a plurality of pixels provided above the first substrate and disposed at intersections of the first scan lines and the second scan lines and signal lines. Each pixel located in an i-th row and a j-th column (i and j are both natural numbers) includes a first transistor, a second transistor, and a pixel electrode. The plurality of pixels are formed in a matrix on the first substrate. A gate of the first transistor is coupled to the first scan line in the i-th row. One of a source and a drain of the first transistor is coupled to the signal line on the j-th column. A gate of the second transistor is coupled to the second scan line in the i-th row. One of a source and a drain of the second transistor is coupled to the other of the source and drain of the first transistor. The other of the source and drain of the first transistor is coupled to the pixel electrode.

19 Claims, 11 Drawing Sheets

U.S. PATENT DOCUMENTS

2009/0295769 A1 12/2009 Yamazaki et al.

FOREIGN PATENT DOCUMENTS

JP 07-325319 A 12/1995
JP 2001-292276 A 10/2001
JP 2005-24864 A 1/2005
JP 2005-84343 A 3/2005
JP 2005-283820 A 10/2005
JP 2006-003857 A 1/2006
JP 2006-133788 A 5/2006

* cited by examiner

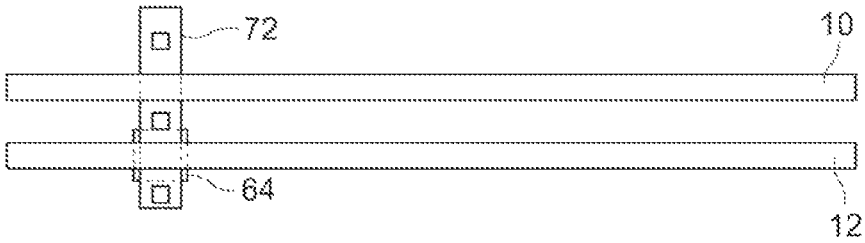
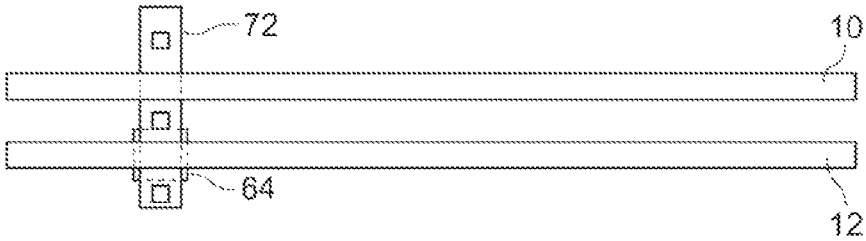
FIG. 9
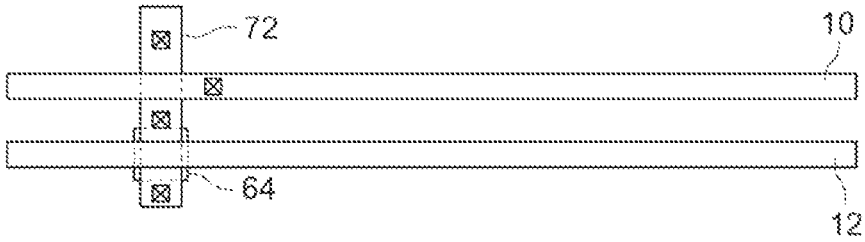
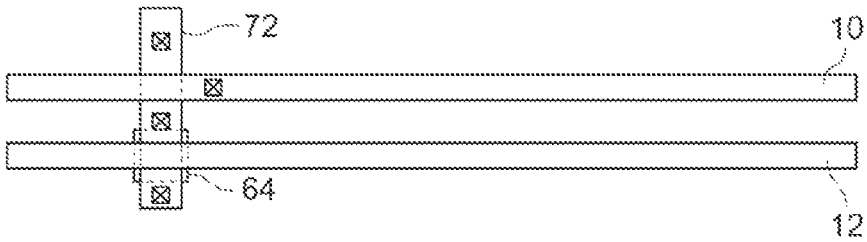
FIG.10

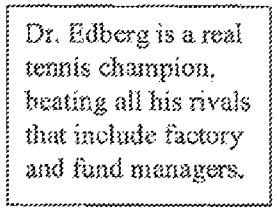

DISPLAY IMAGE INFORMATION FOR K-TH IMAGE DISPLAY PERIOD

FIG.14-(1)

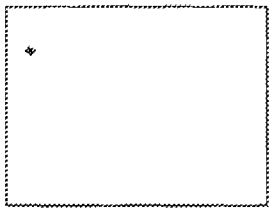

PEN POSITION BASED ON SENSOR SIGNAL DURING K-TH INFORMATION GATHERING PERIOD

FIG.14-(2)

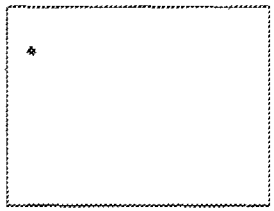

WRITE IMAGE INFORMATION FOR (K+1)-TH IMAGE DISPLAY PERIOD

FIG.14-(3)

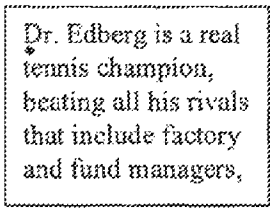

IMAGE DISPLAYED DURING (K+1)-TH IMAGE DISPLAY PERIOD

FIG.14-(4)

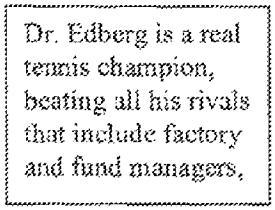

DISPLAY IMAGE INFORMATION FOR (K+1)-TH IMAGE DISPLAY PERIOD

FIG.14-(5)

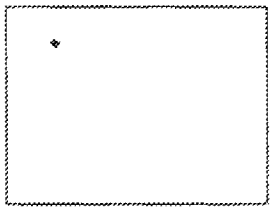

PEN POSITION BASED ON SENSOR SIGNAL DURING (K+1)-TH INFORMATION GATHERING PERIOD

FIG.14-(6)

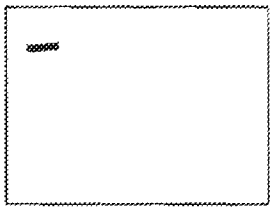

WRITE IMAGE INFORMATION FOR (K+2)-TH IMAGE DISPLAY PERIOD

FIG.14-(7)

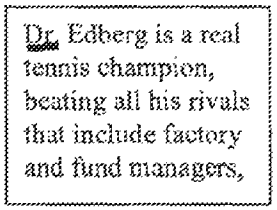

IMAGE DISPLAYED DURING (K+2)-TH IMAGE DISPLAY PERIOD

FIG.14-(8)

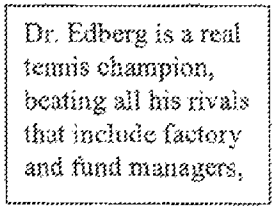

DISPLAY IMAGE INFORMATION FOR (K+2)-TH IMAGE DISPLAY PERIOD

FIG.14-(9)

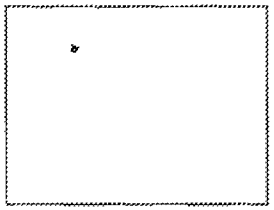

PEN POSITION BASED ON SENSOR SIGNAL DURING (K+2)-TH INFORMATION GATHERING PERIOD

FIG.14-(10)

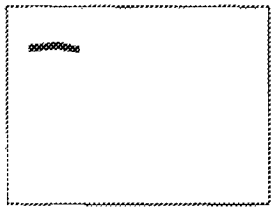

WRITE IMAGE INFORMATION FOR (K+3)-TH IMAGE DISPLAY PERIOD

FIG.14-(11)

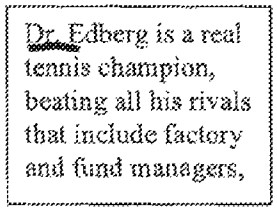

IMAGE DISPLAYED DURING (K+3)-TH IMAGE DISPLAY PERIOD

FIG.14-(12)

ELECTROOPTIC DEVICE AND ELECTRONIC APPARATUS

TECHNICAL FIELD

The present invention relates to an electrooptic device such as an electrophoretic display or a liquid crystal display. More specifically, the invention relates to an electrooptic device that allows information to be displayed thereon, as well as to be written thereto.

RELATED ART

An electrooptic device such as an electrophoretic display or a liquid crystal display is used as the display of an electronic apparatus that can substitute for a traditional paper medium, such as so-called electronic paper or an electronic book. For example, such related-art electrooptic devices are disclosed in JP-A-2005-24864, JP-A-2005-283820, JP-A-2005-84343 and the like. However, such related-art electrooptic devices only display data (e.g., image data of a book, a photo, etc.) previously stored in a memory. In other words, these related-art electrooptic devices have been used only for display, so it has been difficult for a user to perform a process such as freely writing a memo or an underline to a displayed image or specifying a desired position in an image.

SUMMARY

An advantage of the invention is to provide an electrooptic device that serves as a display and as an information gathering device. Specifically, an advantage of the invention is to provide an electrooptic device that allows detection of a position specified on its display screen as well as allows handwriting thereon while having a simple configuration, for use in an electronic apparatus such as electronic paper.

According to a first aspect of the invention, an electrooptic device having an image display period and an information gathering period includes a panel unit and a data processing unit. The panel unit includes a first substrate, a second substrate, an electrooptic material interposed between the first and second substrates, a plurality of first scan lines provided above the first substrate, a plurality of second scan lines provided above the first substrate and disposed in parallel to the first scan lines, a plurality of signal lines provided above the first substrate and intersecting the first scan lines and the second scan lines, and a plurality of pixels provided above the first substrate and disposed at intersections of the first scan lines and the second scan lines and signal lines. Each pixel located in an i-th row and a j-th column (i and j are both natural numbers) includes a first transistor, a second transistor, and a pixel electrode. The plurality of pixels are formed in a matrix on the first substrate. A gate of the first transistor is coupled to the first scan line in the i-th row. One of a source and a drain of the first transistor is coupled to the signal line on the j-th column. A gate of the second transistor is coupled to the second scan line in the i-th row. One of a source and a drain of the second transistor is coupled to the other of the source and drain of the first transistor. The other of the source and drain of the first transistor is coupled to the pixel electrode.

In the electrooptic device according to the first aspect of the invention, the other of the source and drain of the second transistor may be coupled to a reference power supply. Since the first scan line in an (i−1)-th row may be used as the reference power supply, the other of the source and drain of the second transistor may be coupled to the first scan line in the (i−1)-th row. In the electrooptic device according to the first aspect of the invention, the panel unit may further include a holding capacitance provided between the other of the source and drain of the first transistor and the reference power supply. If the first scan line in the (i−1)-th row is used as the reference power supply, the panel unit may include a holding capacitance provided between the other of the source and drain of the first transistor and the reference power supply and the first scan line in the (i−1)-th row.

In the electrooptic device according to the first aspect of the invention, the panel unit may further include a common electrode disposed on the second substrate and a light shielding film disposed between the first substrate and the second transistor. The first substrate may be transparent. The pixel electrode may be formed of a transparent conductive film. If the panel unit includes the holding capacitance, it may further include a common electrode disposed on the second substrate and a light shielding film disposed between the first substrate and the second transistor as described above. The first substrate may be transparent. The pixel electrode may be formed of a transparent conductive film. The holding capacitance may include a holding capacitance first electrode, a holing capacitance second electrode, and a holding capacitance dielectric film interposed therebetween. The holding capacitance first and second electrodes and the holding capacitance dielectric film may be all transparent. The pixel electrode may also serve as the holding capacitance second electrode. The light shielding film may be provided in a position that overlaps an active region of the second transistor. The light shielding film may be provided in a position that does not overlap an active region of the first transistor.

In the electrooptic device according to the first aspect of the invention, the panel unit may further include a first scan selection circuit coupled to the first scan lines and serving to select a particular one from among the plurality of first scan lines, a second scan selection circuit coupled to the second scan lines and serving to select a particular one from among the plurality of second scan lines, a display signal providing circuit coupled to first ends of the signal lines and serving to supply to each signal line a display signal that is unique to each signal line, and a sensor signal reading circuit coupled to second ends of the signal lines and serving to read a sensor signal outputted from each signal line and unique to each signal line, all of which are disposed on the first substrate. In the electrooptic device according to the first aspect of the invention, the data processing unit may include an input unit, a control unit, and a storage unit. The input unit may serve to supply display image information inputted from outside to the control unit or the storage unit. The control unit may serve to control at least the first scan selection circuit, the second scan selection circuit, the display signal providing circuit, the sensor signal reading circuit, and the storage unit. The storage unit may serve to store the display image information and write image information based on the sensor signal. The control unit may serve to create a new display image using the display image information and the write image information and to supply the new display image as a new display signal to the display signal providing circuit. In the electrooptic device according to the first aspect of the invention, the panel unit may further include a switching circuit disposed between the signal lines and the display signal providing circuit for switching between continuity and discontinuity between the signal lines and the display signal providing circuit. The switching circuit may provide continuity between the signal lines and the display signal providing circuit during the image display period. It may provide discontinuity between the signal lines and the display signal providing circuit during the information gathering period.

In the electrooptic device according to the first aspect of the invention, the electrooptic material may be an electrophoretic material, a liquid crystal material, or an electrochromic material.

According to a second aspect of the invention, an electronic apparatus includes the electrooptic device according to the first aspect of the invention.

BRIEF DESCRIPTION OF THE DRAWINGS

The invention will be described with reference to the accompanying drawings, wherein like numbers reference like elements.

FIG. 9 is a plan view showing a process step of forming wiring and the like of the pixel.

FIG. 10 is a plan view showing a process step of forming wiring and the like of the pixel.

FIGS. 14-(1) to 14-(12) are diagrams showing handwriting input mode.

FIG. 14-(1) shows display image information for a K-th image display period.

FIG. 14-(2) shows a pen position based on a sensor signal during a K-th information gathering period.

FIG. 14-(3) shows write image information for a (K+1)-th image display period.

FIG. 14-(4) shows an image displayed during the (K+1)-th image display period.

FIG. 14-(5) shows display image information for the (K+1)-th image display period.

FIG. 14-(6) shows a pen position based on a sensor signal during a (K+1)-th information gathering period.

FIG. 14-(7) shows write image information for a (K+2)-th image display period.

FIG. 14-(8) shows an image displayed during the (K+2)-th image display period.

FIG. 14-(9) shows display image information for the (K+2)-th image display period.

FIG. 14-(10) shows a pen position based on a sensor signal during a (K+2)-th information gathering period.

FIG. 14-(11) shows write image information for a (K+3)-th image display period.

FIG. 14-(12) shows an image displayed during the (K+3)-th image display period.

DESCRIPTION OF EXEMPLARY EMBODIMENTS

Figure 1:
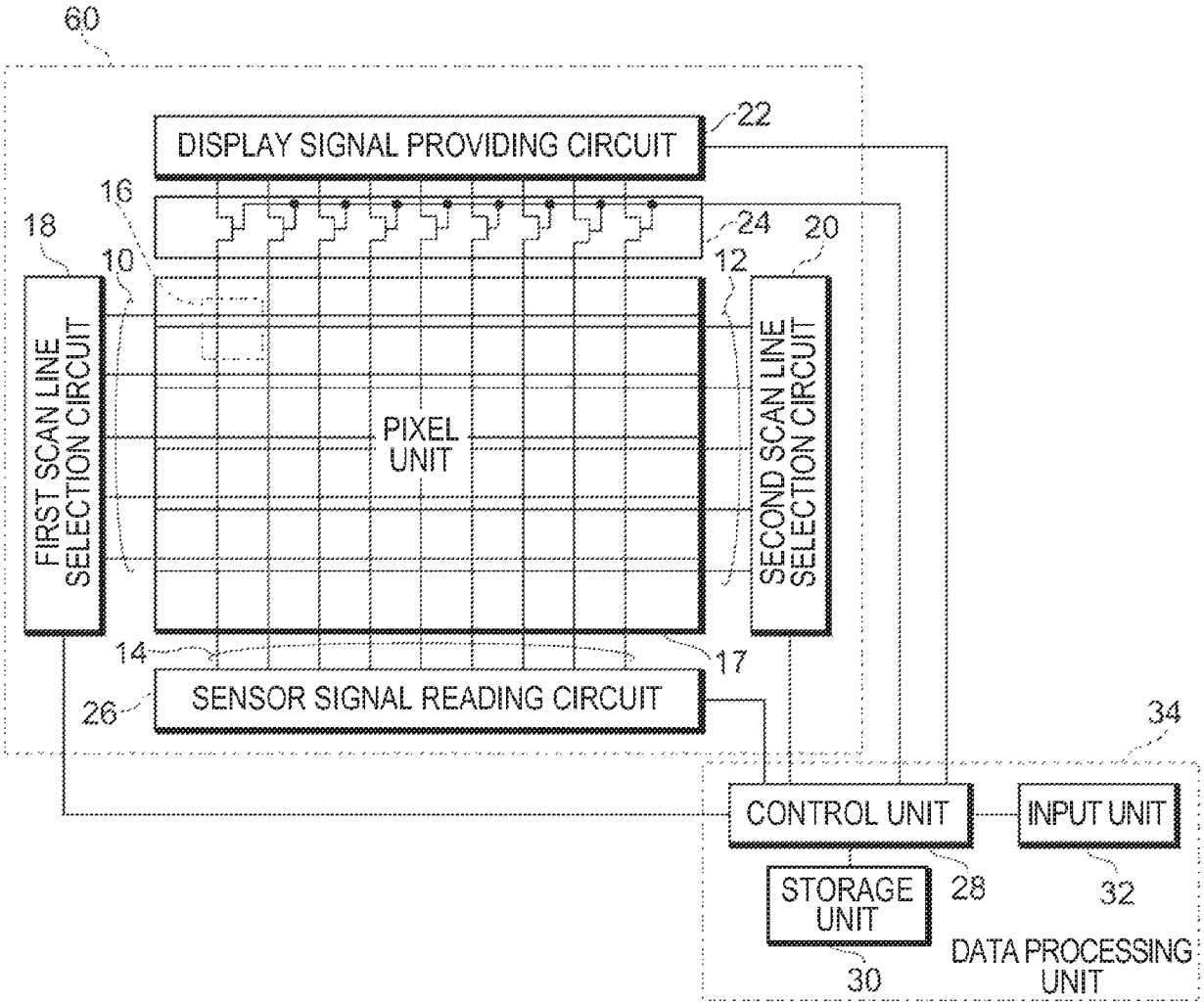
FIG. 1 is a block diagram showing a configuration of an electrooptic device according to an embodiment.

An embodiment of the invention will now be described with reference to the accompanying drawings.

The electrooptic material used in this embodiment is a field-effect display material that changes the display according to an electric field, such as an electrophoretic material or a liquid crystal material, or a current drive display that changes the display according to a current, such as an electrochromic material or an organic electroluminescent material. If a field-effect display material is used, it is interposed between a pixel electrode and a common electrode and a given electric field is applied between these electrodes, thereby allowing various types of display. If a current drive display material is used, the current drive display material (e.g., an electrochromic material; hereafter, an electrochromic material and a display using such a material will be referred to as "ECD") is interposed between the pixel electrode and the common electrode and then a given current is passed between these electrodes; or a circuit for controlling a current source is coupled to the pixel electrode, then a current drive display material (e.g., an organic electroluminescent material; hereafter an organic electroluminescent material and a display using such a material will be referred to as "organic EL") is interposed between this current source and the common electrode, and a given current is passed between the current source and the electrode. Thus, various types of display are allowed. This embodiment is commonly available even if any one of these electrooptic materials is used, and will be described in detail using an electrophoretic material as an example of the electrooptic material. An electrophoretic display (EPD) will be used as an example of the electrooptic device according to the invention in the description below.

This embodiment relates to an electrooptic device (hereafter referred to as "this device") having an image display period and an information gathering period. An image display period means a period during which this device displays, on a functional plane thereof, information on a display image for one screen inputted from the outside in the form of an electric signal, an electromagnetic wave signal, or the like. An image display period is also referred to as an "image display frame." This device serves as a display during this period. An image display frame corresponds to one frame for an ordinary display. On the other hand, an information gathering period means a period during which the functional plane serves as a plane sensor, and is also referred to as an "information gathering frame." During this period, this device serves as an information gathering device to gather sensor information for one screen. For example, during an information gathering period, a user of this device spatially moves an input device on the functional plane to input information. The user is able to specify a specific position on the functional plane during this period by using a pen-shaped light emitting device as the input device. In addition, combining an image display period and an information gathering period allows inputting of handwriting to this device. As can be seen, this device is a typical electrical display (e.g., an electronic book) as well as an electrical writing device (e.g., an electronic notebook).

Figure 2:
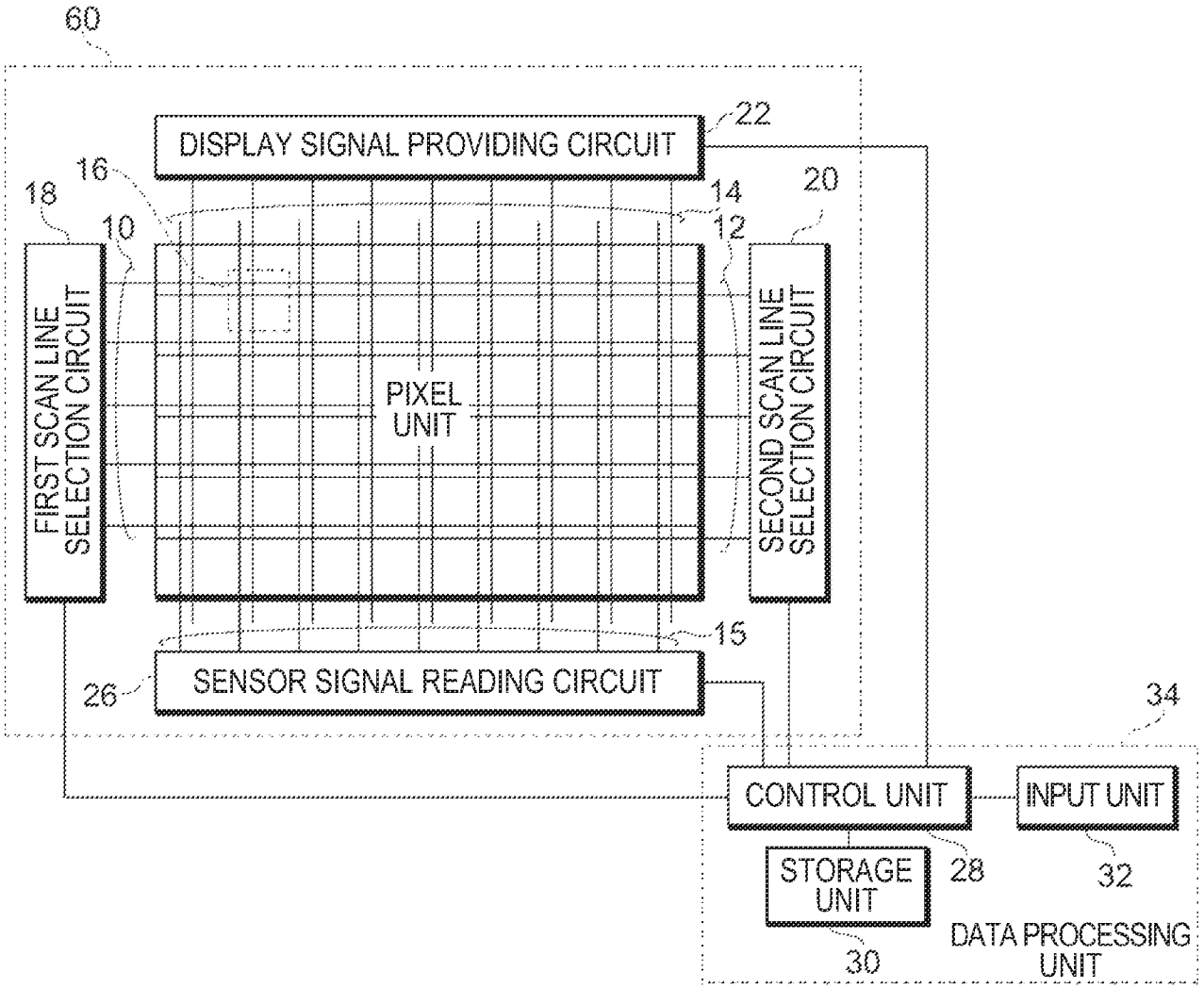
FIG. 2 is a block diagram showing a configuration of an electrooptic device according to the embodiment.

FIGS. 1 and 2 show circuit configurations of the electrooptic device according to this embodiment. This device includes at least a panel unit and a data processing unit. The panel unit includes a first substrate, a second substrate, and an electrooptic material interposed between these substrates. FIGS. 1 and 2 both depict a first substrate 60 constituting a part of the panel unit and a data processing unit 34. Provided above the first substrate 60 are multiple first scan lines 10, multiple second scan lines 12 that are disposed in parallel with the first scan lines 10, multiple signal lines 14 that intersect the first scan lines 10 and the second scan lines 12, and multiple pixels 16 that are disposed at intersections of the first scan lines 10 and the second scan lines 12 and the signal lines 14. The multiple pixels are arranged in a matrix above the first substrate 10 to constitute a pixel unit. An example shown in FIG. 2 also includes multiple reading lines 15 that are disposed in parallel with the signal lines 14. All the pixels have an image display function and an information input function in this embodiment, so the first scan lines 10 and the second scan lines 12 are equal in number. Further, in the example of FIG. 2, the signal lines 14 and the reading lines 15 are equal in number. If it is desired that pixels having an image display function and pixels having an information input function are different in number, the first scan lines 10 and the second scan lines 12, or the signal lines 14 and the reading lines 15 need not be equal in number.

Figure 3:
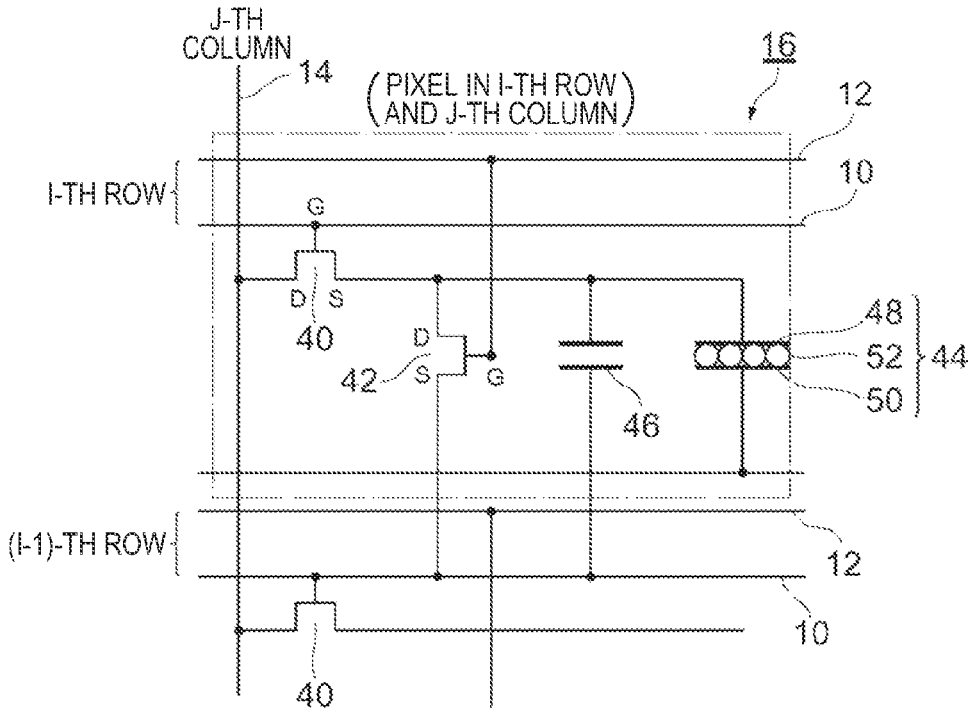
FIG. 3 is a circuit diagram showing a detailed configuration of a pixel.
Figure 4:
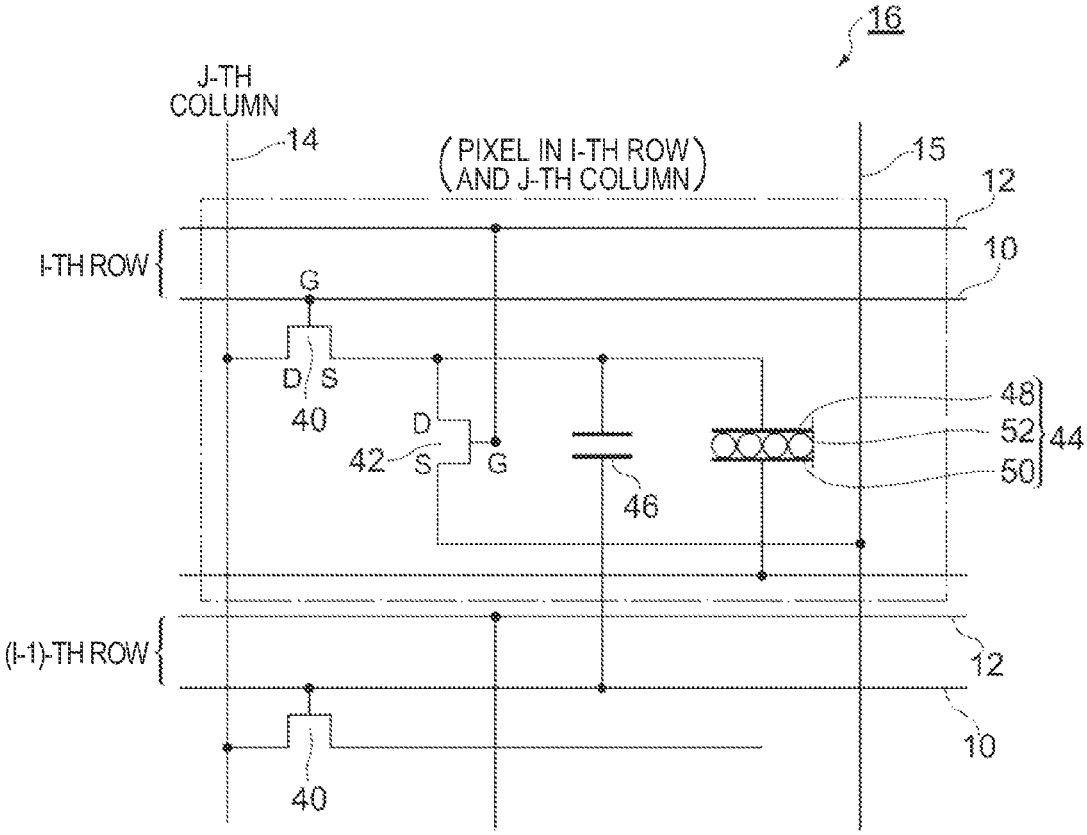
FIG. 4 is a circuit diagram showing a detailed configuration of a pixel.

FIGS. 3 and 4 are circuit diagrams showing detailed configurations of pixels corresponding to FIGS. 1 and 2, respectively, and each show a pixel positioned in an i-th row and a j-th column (i and j are natural numbers). Each pixel 16 includes a first transistor 40, a second transistor 42, and a pixel electrode 48. The first and second transistors 40 and 42 are both a thin film transistor (TFT). Since the invention is being described herein using an example in which an image is displayed on an electrophoretic display (EPD) during an image display period, the first transistor 40 serving as a pass gate with respect to a display signal is also referred to as an "EPD switching TFT." Similarly, since a light emitting device is used as an example of an input device for inputting handwriting during an information input period and since it is assumed that each pixel will detect light, the second transistor 42 serving to specify a pixel that is detecting light is also referred to as a "photo sensor switching TFT." Further, the first scan lines 10 serving to control the on/off state of the first transistors 40 are also referred to as "EPD scan lines," and the second scan lines 12 serving to control the on/off state of the second transistors 42 are also referred to as "photo sensor scan lines." In a pixel in the i-th row and the j-th column in this embodiment, the gate of the first transistor 40 is coupled to the first scan line 10 on the i-th row and one of the source and drain of the first transistor 40 is coupled to the signal line 14 on the j-th column. To be exact scientifically, the relation between the source and drain of a transistor is exchangeable according to input signals, so any one of the two terminals of the transistor cannot be defined as the source or drain. However, in this specification, one of the two terminals will be referred to as the drain and the other as the source for convenience. In FIGS. 3 and 4, the drain of the first transistor 40 is coupled to the signal line 14 in the j-th column. Further, in this embodiment, the gate of the second transistor 42 is coupled to the second scan line 12 in the i-th row, and one of the source and drain of the second transistor 42 (drain of the second transistor) is coupled to the other of the source and drain of the first transistor 40 (source of the first transistor), and the other of the source and drain of the first transistor 40 (source of the first transistor) is coupled to the pixel electrode 48. The other of the source and drain of the second transistor 42 (source of the second transistor) is coupled to a reference power supply. The reference power supply may be either of a high voltage source (a so-called positive power supply of 3.3 V, 5 V, etc.) and a low voltage source (a so-called negative power supply of 0 V, etc.). Unlike the example shown in FIG. 3, a dedicated reference power supply line may be provided every row or every two rows. However, since the first scan line (first scan line of an adjacent pixel) in an (i−1)-th row may be used as the reference power supply, the other of the source and drain of the second transistor 42 (source of the second transistor) is coupled to the first scan line 10 in the (i−1)-th row. Thus, the potential of the first scan line that is in a non-selected state serves as the reference power supply. If an n-type transistor is used as the first transistor 40, the source of the second transistor 42 is coupled to a low voltage source during a period when the pixel is not selected. On the other hand, if the reading line 15 that is unique to each pixel is provided as shown in FIG. 4, a high voltage source or a low voltage source serves as the reference power supply. An ammeter is provided at an end of the reading line 15 and a high voltage power supply or a low voltage supply is coupled to the reading line 15. If a high voltage source is coupled to the ammeter, the signal line 14 in the j-th column is coupled to a low voltage source during an information gathering period. If a low voltage source is coupled to the ammeter, the signal line 14 in the j-th column is coupled to a high voltage source during an information gathering period. In any case, the source of the second transistor 42 is coupled to a high voltage power supply or a low power supply serving as the reference power supply via the reading line 15 and the ammeter.

The above-mentioned configuration makes this device a display that allows inputting of handwriting thereto. Here, the principle will be described. A display that allows inputting of handwriting thereto refers to a display in which each pixel serves to display an image during an image display period as well as serves to gather information, such as to detect light, during an information gathering period. First, all the second scan lines 12 are put in a non-selecting state during an image display period. A non-selecting state refers to a state in which a transistor (in this case, the second transistor 42) to be controlled by a scan line is not selected by the scan line. For example, a non-selecting state is a state in which if an n-type TFT is used as the corresponding transistor (second transistor 42), the scan line is put at a low potential (a state in which the second scan line 12 is coupled to a low voltage power source). If the second transistor 42 is put in a non-selected state (if the second transistor 42 is put in a highly resistant, off state), each pixel is able to control the potential of the pixel electrode using the first transistor 40. Therefore, as with a liquid crystal display (LCD) or an EPD, this device serves as an ordinary display. On the other hand, each pixel serves as a light detector during an information gathering period. In this case, all the first scan lines 10 are put in a non-selecting state and the first transistors of all the pixels are put in an off state. The transistors that are put in an off state each generate a light leak current in accordance with the intensity of light applied thereto. If no light is applied, the off currents of the transistors are very small; if strong light is applied, the off currents are significantly increased due to the light leak currents. This is because when the transistors are in an off state, a positive-negative junction (p-n junction) is electrically formed at each of the drain terminals of the transistors and each p-n junction serves as a photo diode. This characteristic is constructively utilized in this embodiment, that is, the transistors (first transistors), which determine the go/no-go of passage of a display signal during an image display period, are used as photo sensors for determining the illumination of strong light during an information gathering period. Specifically, all the first scan lines 40 are put in a non-selecting state to put all the first transistors 40 in an off state. The second scan lines 12 are sequentially selected with the first transistors 40 serving as photo sensors and the second transistor 42 controlled by the selected second scan line 12 is put into an on state. Thus, the signal line 14 leads to the reference power supply via the first transistor 40 serving as a photo sensor and the second transistor 42 that is put in an on state. As a result, the amount of a current that is generated between the signal line 14 and the reference power supply is changed according to the intensity of light applied to the first transistor 40. This change is detected to measure the amount of the light applied to the pixel. In short, if strong light is applied to a pixel selected by the second scan line selection circuit 20 and the sensor signal reading circuit 26, the corresponding first transistor 40 generates a large light leak current, whereby a large current is detected. If no light is applied to a pixel selected by the second scan line selection circuit 20 and the sensor signal reading circuit 26, the first transistor 40 generates almost no light leak current, whereby only a very weak current is detected. Thus, in this device, each pixel displays an image during an image display period, while it detects the amount of applied light during an information gathering period.

In this embodiment, a holding capacitance may be provided between the other of the source and drain of the first transistor 40 (source of the first transistor) and the reference power supply so that an image of high quality is displayed during an image display period. Providing such a holding capacitance allows an improvement in image quality, such as an increase in contrast ratio of an EPD or an increase in display gradations of an LCD. If the first scan line 10 in the (i−1)-th row is used as the reference power supply as described above (FIG. 3), a holding capacitance 46 is provided between the other of the source and drain of the first transistor 40 (source of the first transistor) and the first scan line 10 in the (i−1)-th row. The holding capacitance 46 must be coupled to a fixed power supply during a period when a display signal is maintained by the pixel (a period when the pixel is not selected). Therefore, if the reference power supply having a high or low potential passes through the reading line as shown in FIG. 4, the holding capacitance 46 is preferably provided between the other of the source and drain of the first transistor 40 (source of the first transistor) and the first scan line 10 in the (i−1)-th row. If the first scan line 10 in the (i−1)-th row is used as the reference power supply, the aperture ratio of the pixel (the ratio of the pixel electrode area to be used for display to the pixel area) is increased because a reference power supply line need not be provided additionally. As a matter of course, additional wiring may be provided as necessary such that the other of the source and drain of the second transistor (source of the second transistor) and the holding capacitance are coupled to the wiring. In FIG. 3, another first scan line 10 for controlling an adjacent pixel also serves as a reference power supply line.

A sectional configuration of this device will now be described with reference to FIG. 5. In this embodiment, the first transistor is used as a photo sensor during an information gathering period, so light must reach the first transistor during this period. Assume a display in which an electrooptic material is interposed between the first and second substrates and seen from the second substrate side (from an upper part of FIG. 5). When the display shows black and therefore light is shielded, no light reaches the first transistor manufactured on the first substrate from the second substrate side. Specifically, if a non-transparent electrooptic material such as an ECD or EPD is used, light does not reach the first transistor from the second transistor side, regardless of what the display shows. Thus, this device has a configuration in which its display is seen from the first substrate side. This device has an electrooptic material interposed between the first and second substrates, and the outer surface of the first substrate serves as a functional plane. Therefore, a user views this device or inputs handwriting thereto from the outside of the first substrate (from a lower part of FIG. 5). This allows this device to serve to display an image as well as serve to gather information, regardless of what the display shows or what the type of the electrooptic material is. Specifically, if an LCD is used, a backlight serving as a light source is disposed outside the second substrate; if an organic EL is used, light is emitted toward the first substrate (so-called bottom emission type). Therefore, in the case of this embodiment having the circuit configuration described above in detail, a transparent glass substrate, a plastic film made of a transparent resin material, or the like that becomes transparent to visible light is used as the first substrate. On the other hand, the second substrate is not required to have a particular level of transparency. The second substrate may be a transparent or non-transparent glass or film, or paper, fibers, a semiconductor substrate, a metal board, or the like.

Figure 5:
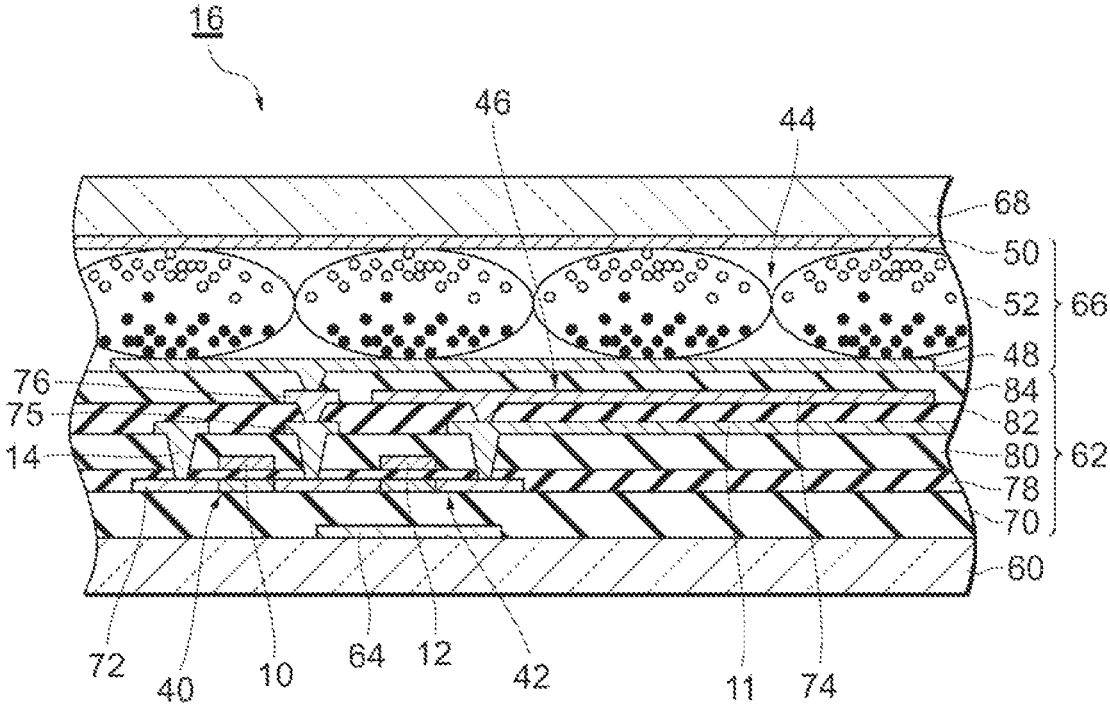
FIG. 5 is a partial sectional view schematically showing a sectional configuration of a pixel of an electrooptic device.

As shown in FIG. 5, the electrooptic device according to this embodiment includes the transparent first substrate 60, the second substrate 68 disposed so as to be opposed to the first substrate 60, and the electrooptic material 52 interposed between this pair of substrates. Disposed on the first substrate are a circuit layer 62, a light shielding film 64, and the pixel electrode 48. The light shielding film 64 is disposed in a predetermined position between the first substrate 60 and the circuit layer 62. The pixel electrode 48 is formed on the circuit layer 62 so as to come into contact with the electrooptic material 52. An electrooptic element layer 66 includes the pixel electrode 48, the common electrode 50, and the electrooptic material 52. In an electrooptic device (a vertical EPD or ECD shown in FIG. 5, or an LCD that is not of in-plane-switching type) that generates an electric field or a current in a direction perpendicular to the first substrate, the common electrode 50 is formed on the inner surface of the second substrate. In an electrooptic device (a horizontal EPD, an in-plane switching LCD, an organic EL, etc.) that generates an electric field or a current in a direction parallel to the first substrate, the common electrode 50 is formed on the first substrate. In this embodiment, the electrooptic material is seen from the first substrate 60 side and each pixel electrode 48 has a large area on the corresponding pixel, so the pixel electrodes 48 are formed above the first substrate 60 using a transparent conductive film. This allows a displayed image to be seen from the first substrate 60 side.

The circuit layer 62 includes the first scan line 10, the second scan line 12, the signal line 14, the first transistor 40, the second transistor 42, and the holding capacitance 46. The circuit layer 62 also includes the reading line 15 in the configurations shown in FIGS. 2 and 4. As described above, the first and second transistors 40 and 42 are both formed using a field-effect thin film transistor. In addition to these configurations, the light shielding film 64 is further disposed between the first substrate 60 and the second transistor 42 in this embodiment. The light shielding film 64 serves to shield visible light. Specifically, a metal film made of aluminum, chrome, tungsten, or the like, or a relatively thick semiconductor film with a thickness of 100 to 500 nm is used as the light shielding film 64. The light shielding film 64 serves to prevent light from the first substrate 60 side from entering a semiconductor portion 72 (active area) of the second transistor 42. On the other hand, the shielding film 64 must be provided in a position that does not overlap the active area of the first transistor 40. An "active area" here refers to an area including a channel forming area, a drain area adjacent to the channel forming area, and a source area adjacent to the channel forming area. In order for the first transistor 40 to serve as a photo sensor during an information gathering period, light must be applied to the drain terminal of the first transistor 40. On the other hand, the second transistor 42 serves to specify a desired pixel during an information gathering period, so it must not malfunction due to light applied thereto. Therefore, in this embodiment, the light shielding film 64 is disposed only below the second transistor 42 at least so that light does not enter the active area of the second transistor 42. This avoids the second transistor 42 from malfunctioning due to light, allowing this device to properly operate as an information gathering device. The light shielding film 64 is intended to prevent the second transistor 42 from malfunctioning due to a light leak current, so it need not have a perfect light shielding effect. It is sufficient for the light shielding film 64 to shield light to the extent that the second transistor 42 does not malfunction. Use of an amorphous or polycrystalline silicon film as the light shielding film 64 allows the circuit layer 62 to be manufactured in an ordinary TFT manufacturing process. This is convenient. In this case, if the light shielding film 64 has a thickness of 100 to 500 nm, the purpose of shielding light is achieved. While the light shielding film 64 with a larger thickness has a larger light shielding effect, a problem such as an increase in step height of such a light shielding film or peeling thereof often occurs. Therefore, the thickness of a semiconductor film serving as the light shielding film 64 is ideally 150 to 300 nm.

If the holding capacitance 46 is provided, all components thereof are desirably transparent. The holding capacitance 46 includes a holding capacitance first electrode, a holding capacitance second electrode, and a holding capacitance piezoelectric film, and all these components are desirably transparent. As described above, in this embodiment, the outer plane of the first substrate 60 serves as a functional plane, and a displayed image is seen from the first substrate 60 side. Therefore, the first substrate 60 is transparent and the pixel electrode 48 is formed using a transparent conductive film. The holding capacitance 46 has a relatively large area on the pixel. Particularly, in an EPD, the holding capacitance 46 sometimes has an area making up 50% or more of that of the entire pixel. The holding capacitance 60 with a large area is also desirably transparent so that the electrooptic material appears beautiful when this device is seen from the first substrate 60 side.

A configuration of the circuit layer 62 will now be described. An insulating film 70 is a base protection film and is formed on the first substrate 60 so as to cover the light shielding film 64. Formed on the upper surface of the insulating film 70 is an island-shaped semiconductor film 72. The semiconductor film 72 may be one island shared by the first and second transistors 40 and 42 as shown in FIG. 5, or may be separate islands corresponding to the respective transistors. An insulating film 78 serves as a gate insulating film for each transistor and is formed on the insulating film 70 so as to cover at least the channel forming area of the semiconductor film 72. Formed on the insulating film 78 and in a predetermined position above the semiconductor film 72 are the first and second scan lines 10 and 12. The first and second scan lines 10 and 12 extend up to above the semiconductor film 72 and serves as the gate electrodes of the first and second transistors 40 and 42, respectively. An insulating film 80 serves as a first inter-layer insulating film and is formed on the insulating film 78 so as to cover the first and second scan lines 10 and 12. The signal line 14 and the reading line 15 are formed on the insulting film 80 and coupled to the semiconductor film 72 and the like via contact holes provided in the insulating film 80 as appropriate. As such, wiring 11 is formed on the insulating film 80 and coupled to the semiconductor film 72, the reference power supply (first scan line in the (i−1)-th row, etc), and the like via contact holes provided in the insulating film 80 as appropriate. An insulating film 82 serves as a second inter-layer insulating layer and is formed on the insulating film 80 so as to cover the wiring 11, signal line 14, and other wiring 75. Formed on the insulating film 82 is an electrode 74 (holding capacitance first electrode) that is a first electrode of the holding capacitance 46. The holding capacitance first electrode 74 is coupled to the wiring 11 via a contact hole provided in the insulating film 82 as appropriate. An insulating 84 serves as a third inter-layer insulating film and also as a holding capacitance dielectric film. The holding capacitance dielectric film is formed on the insulating film 82 so as to cover the holding capacitance first electrode 74 and wiring 76. As for this device, it is assumed that a displayed image is seen from the first substrate 60 side, as described above. Therefore, the insulating films 70, 78, 80, 82, and 84 are all transparent. Specifically, silicon oxide films or silicon nitride films are used as these insulating layers. The pixel electrode 48 formed on the third inter-layer insulating film also serves as a holding capacitance second electrode, and is formed using a transparent conductive film, as described above. A contact hole is made in the third inter-layer insulating film and the pixel electrode 48 is coupled to the wiring on a lower layer (in this case, wiring 76) so that the pixel electrode 48 is coupled to the source of the first transistor. The wiring 76 is coupled to the wiring 76 via a contact hole made in the insulating film 82. Thus, the pixel electrode 48 is coupled to the semiconductor film 72 via the wiring 75 and 76. Both the pixel electrode 48 and the holding capacitance first electrode 74 are preferably transparent conductive films, so these electrodes are formed of indium tin oxide (ITO) or the like. The electrooptic material 52 is formed on the pixel electrode 48 and above the insulating film 84, if necessary, with an insulating film or the like therebetween. Assuming that the electrooptic material 52 is an electrophoretic material containing white particles and black particles and that the while particles are charged positively and the black particles are charged negatively, this embodiment will be described below. In this embodiment, the second substrate 68 having the common electrode thereon is provided so as to cover the electrooptic material 52. The electrooptic material 52 interposed between the pixel electrode 48 and the common electrode 50 forms an electrooptic element 44. If the common electrode 50 is formed on the second substrate, it is not required to have a particular level of transparency. Therefore, a non-transparent metal conductive film made of aluminum or the like, or a transparent conductive film made of ITO or the like is used as the common electrode 50 as appropriate. If the common electrode 50 is formed on the first substrate, a transparent conductive film made of ITO or the like is preferably used as the common electrode 50.

In this embodiment having the above-mentioned circuit configuration and sectional configuration, the first scan line selection circuit 18, the second scan line selection circuit 20, the display signal providing circuit 22, and the sensor signal reading circuit 26 (FIGS. 1 and 2) are formed on the first substrate 60. While external integrated circuits may be used as these circuits, these circuits are preferably manufactured as TFTs in the process step of manufacturing TFTs included in a pixel unit. The first scan line selection circuit 18 is coupled to the multiple first scan lines 10 and serves to select a particular one from among these scan lines. The second scan line selection circuit 20 is coupled to the multiple second scan lines 12 and serves to select a particular one from among these scan lines. The display signal providing circuit 22 is coupled to first terminals of the multiple signal lines 14 and serves to provide a display signal unique to each of these signal lines, to each signal line. The sensor signal reading circuit 26 is coupled to second terminals of the multiple signal lines 14 (FIG. 1) or second terminals of the multiple reading lines 15 (FIG. 2) and serves to read a sensor signal outputted from each of these lines and unique to each of these lines. Specifically the sensor signal reading circuit 26 includes a selection circuit including a shift register, a decoder, and the like and a current comparison circuit (ammeter) including an operation amplification circuit and the like. A weak photo sensor signal indicated by the signal line 14 or reading line 15 selected by the selection circuit is amplified and measured by the current comparison circuit (ammeter).

Further, in this embodiment, the data processing unit 34 includes an input unit 32, a control unit 28, and a storage unit 30. The input unit 32 serves to provide information on a display image inputted as an electric signal from the outside to the control unit 28 or the storage unit 30, as well as serves to transmit various input instructions provided by a user to the control unit 28. An input instruction refer to an electric signal representing a user's intent indicated using, for example, a directional key (cross key, etc.), a push button, or the like. The input unit 32 also receives such signals. For example, although described in detail later, the input unit 32 receives a signal for switching between display mode and handwriting input mode and transmits the signal to the control unit 28. The control unit 28 serves to control at least the first scan line selection circuit 18, the second scan line selection circuit 20, the display signal providing circuit 22, the sensor signal reading circuit 26, and the storage unit 30. The storage unit 30 serves to store information on a displayed image and information on a written image based on a sensor signal. Information on a written image refers to information synthesized from a sensor signal gathered by this device during an information gathering period and corresponds, for example, to handwriting input information written onto the functional surface of this device by a user using a pen-shaped light emitting device. The control unit 28 acquires data (hereafter referred to as "read data") read by the sensor signal reading circuit 26 and stores the read data in the storage unit 30. Then, the control unit 28 creates information on a written image on the basis of the read data acquired during a single or multiple information gathering periods (information gathering frames). Further, the control unit 28 serves to create a new image for display using the information on a displayed image stored in the storage unit 30 and this information on a written image and to provide the new image for display to the display signal providing circuit 22 as a new display signal. Furthermore, upon receipt of an input instruction, the control unit 28 serves to select a circuit necessary to operate, from among the display signal providing circuit 22, the sensor signal reading circuit 26, the first scan line selection circuit 18, the second scan line selection circuit 20, and the like and to provide a necessary signal to the selected circuit or receive a signal therefrom. The storage unit 30 is configured using a semiconductor memory such as a dynamic random access memory (DRAM) or a static random access memory (SRAM). It serves to store information on a displayed image, read data, information on a written image, and various types of data created or to be used by the control unit 28.

In this embodiment, if there are provided no dedicated reading lines 15 and the signal lines also serve as reading lines (FIG. 1), there is provided a switching circuit 24 between the signal lines 14 and the display signal providing circuit 22. The switching circuit 24 includes pass gates and switches between the continuity and discontinuity between the signal lines 14 and the display signal providing circuit 22 on the basis of a control signal provided by the control unit 28. The switching circuit 24 provides continuity between the signal lines 14 and the display signal providing circuit 22 during an image display period, while it provides discontinuity therebetween during an information gathering period. In other words, when the display signal providing circuit 22 provides display image signals to the signal lines 14, the switching circuit 24 is brought into conduction; when the sensor signal reading circuit 26 reads sensor signals from the signal lines 14, it is brought into non-conduction.

Thus, this device having the above-mentioned configuration serves both as a display and as an information gathering device. Referring now to FIGS. 1, 2, and 14, a method for driving this device and a usage method thereof will be described.

This device has display mode in which the functional plane thereof serves as a display and handwriting input mode in which a user inputs handwriting to the functional plane. In handwriting input mode, the functional plane serves both as a display and as a plane sensor. Display mode includes only a single or multiple image display periods (image display frames), and this device serves as a display using this image display frame(s). On the other hand, in handwritten mode, an image display period (image display frame) and an information gathering period (information gathering frame) are repeated alternately so that handwriting is inputted to the display screen. These modes will be described below in detail.

(1) Display Mode

Display mode includes a single or multiple image display frames, and this device serves as a display in this frame(s). This device performs the following operations in each image display frame. In display mode, first, the control unit 28 causes the second scan line selection circuit 22 and the sensor signal reading circuit 26 to completely stop operating. Thus, the second scan line selection circuit 22 is put in a state in which the circuit is selecting none of the second scan lines 12. If the second transistors 42 are of n-type, all the second scan lines 12 are maintained at a minimum potential (e.g., 0 V). Thus, all the second transistors 42 are put in an off state. Further, if this device includes no dedicated reading lines and the signal lines 14 also serve as reading lines (FIG. 1), the control unit 28 brings the switching circuit 24 into conduction so as to couple the display signal providing circuit 22 and the signal lines 14. Information on a displayed image acquired from the input unit 32 is stored in the storage unit 30 and converted into data for display for each row. Then, the control unit 28 transmits data for display corresponding to the first scan line 10 to be selected, to the display signal providing circuit 22. Subsequently, the control unit 28 causes the first scan line selection circuit 18 to operate so that a desired first scan line 10 is selected from among the multiple first scan lines 10. If the first transistors 40 are of n-type, the selected first scan line 10 is given a maximum potential (e.g., 5 V); the non-selected first scan lines 10 are maintained at a minimum potential (e.g., 0 V). With the desired first scan line 10 selected, the display signal providing circuit 22 provides data for display to each pixel via the signal lines 14. Thereafter, similar operations are repeated with respect to pixels to which data for display must be provided. Thus, one image display frame is completed (one image display period ends). In order to display moving images or display an image different from that displayed in the preceding image display frame, in the next image display frame, the above-mentioned operations are repeated to create the next image display frame.

Here, assume that white particles are charged positively and black particles are charged negatively in an EPD. The second scan line selection circuit 20 and the sensor signal reading circuit 26 completely stop operating (therefore, all the second scan lines 12 are maintained at a minimum potential (e.g., 0 V)). With the switching circuit 24 brought into conduction, a white image is displayed over the entire screen in the first image display frame (this operation will be referred to as "white reset" and corresponds to erasing the entire screen into white). Then, information on an intended image for display is displayed in the next image display frame. The common electrode 50 is given a maximum potential (e.g., 6 V) at the white reset; it is maintained at a low potential (e.g., 0.5 V) when information on an image for display is written to each pixel. The reason why the common electrode is maintained at a low potential (e.g., 0.5 V) rather than at a minimum potential (e.g., 0 V) when information on an image for display is written to each pixel is to maintain the displayed image even during an information gathering period with the potential of the common electrode set to a minimum potential (e.g., 0 V) and with the potential of the common electrode and those of non-selected first scan lines (EPD scan lines) 10 matched. In an image display frame in which information on an intended image for display is displayed, the display signal providing circuit 22 provides display signals having a maximum potential (e.g., 5V) to the signal lines 14 when a pixel is displayed in black (black writing); it provides display signals having a minimum potential (e.g., 0 V) to the signal lines 14 when a pixel is displayed in white (white writing). In that frame, the common electrode 50 is maintained at a low potential (e.g., 0.5 V).

(2) Handwriting Input Mode

In handwriting input mode, an image display period and an information gathering period are repeated alternately. Referring now to FIG. 14, handwriting input mode will be described below. The method for displaying an image on the functional plane during an image display period is the same as that in display mode mentioned above. FIG. 14-(1) shows an example of display image information for a k-th image display period and a sentence is displayed on the functional plane. Information on an image displayed during a k-th image display period refers to an image displayed during an image display period immediately before the current information gathering period starts.

When a user inputs handwriting onto the functional plane of the this device, the user first provides an instruction for a switching operation from display mode to handwriting input mode. Upon receipt of a signal representing such an instruction, the input unit 32 communicates the contents of the signal to the control unit 28. Accordingly, the control unit 28 performs control for switching from display mode to handwriting input mode. Specifically, an information gathering period starts, and subsequently an image display period and an information gathering period are repeated alternately. Once an information gathering period has started, the control unit 28 causes the display signal providing circuit 22 and the first scan line selection circuit 18 to stop operating, while it causes the second scan line selection circuit 20 and the sensor signal reading circuit 26, both of which have stopped operating during an image display period, to operate. Concurrently, if the switching circuit 24 is provided (FIG. 1), it is brought into conduction so as to separate the display supply circuit 22 and the signal lines 14.

In the EPD in which white particles are charged positively and black particles are charged negatively, the control unit 28 performs the following image maintenance operation on each circuit in order to maintain an image displayed in display mode even during an information gathering period. Once an information gathering period has started, the control unit 28 reduces the potential of the common electrode 50 from a low potential (e.g., 0 V) until then to a minimum potential (e.g., 0 V). Concurrently, the control unit 28 puts all the first scan lines 10 at a minimum potential to put all the first transistors in an off state. Thus, the holding capacitances and the pixel electrodes, and the signal lines are completely separated. Then, the control unit 28 temporarily puts all the second scan lines 12 in a selected state to increase the potentials of these scan lines to a maximum potential (e.g., 5 V). Thus, all the second transistors in the pixel unit are put in an on state and continuity is provided between the reference power supply (in this case, minimum potential of 0 V) and the pixel electrodes, whereby the potentials of all the pixel electrodes are reduced to a minimum potential. Although the potentials of all the pixel electrodes are reduced to a minimum potential, the image is maintained. This is because the pixel electrodes and the common electrode are put at the same potential since the potential of the common electrode is also reduced to a minimum potential almost simultaneously. If the difference between the time at which the common electrode is reduced to a minimum potential and the time at which the pixel electrodes are reduced to a minimum potential is one-tenth or less of the response time of the EPD material, the particles (white particles and black particles) making up the EPD material do not nearly move and therefore the image is maintained. The response time of the EPD material is typically several hundred milliseconds, so the time difference must be several tens of milliseconds or less. Subsequently, controlled by the control unit 28, the second scan line selection circuit 20 reduces the potentials of all the second scan lines 12 to a minimum one (e.g., 0 V) to temporarily put all the second transistors 42 in an off state. The image is maintained in this way and then the control unit 28 starts gathering information. Specifically, the control unit 28 causes each pixel to serve as a photodetector, and determines whether light has been applied to each pixel and measures the illumination of the light. During an information gathering period, the first scan line selection circuit 18 puts all the first scan lines 10 in a state in which these scan lines are not selected and provides scan signals having a minimum potential (e.g., 0 V) to these scan lines to put all the first transistors 40 in the pixel unit in an off state. Thus, the first transistors 40 serve as photodiodes. On the other hand, the second scan line selection circuit 20 selects the second scan lines 12 sequentially and puts the second transistors 42 coupled to the selected row in an on state. If the second transistors 42 are of n-type, a photosensor scan signal having a maximum potential (e.g., 5 V) is provided to the selected second scan line 12. With a particular second scan line 12 (e.g., second scan line in the i-th row) selected, the potential of the signal line 14 in the j-th column is made opposite to that of the reference power supply. For example, if the reference power supply is put at a low potential, the signal line 14 is put at a high potential (e.g., 5 V); if the reference power supply is put at a high potential, the signal line 14 is put at a low potential (e.g., 0.5 V). Thus, the high voltage source is coupled to the low voltage source via the ammeter constituting a part of the sensor signal reading circuit 26, the signal line, a first transistor 40 that is put in an off state in a pixel selected to detect light, and a second transistor 42 that is put in an on state in the pixel selected to detect light. If the light detected in the selected pixel has high illumination, the first transistor 40 generates a light leak current, thereby generating an off current whose amplitude varies with the illumination of the light. The sensor signal reading circuit 26 reads this off current to measure the illumination of the light in the selected pixel (in this case, the pixel in the i-th row and the j-th column). Subsequently, the sensor signal reading circuit 26 selects the columns sequentially to read a photosensor signal (read data) from each pixel. The obtained read data is transmitted from the sensor signal reading circuit 26 to the control unit 28 and stored in the storage unit 30. Thereafter, the sensor signal reading circuit 26 sequentially selects the columns and stores the read data obtained from the selected pixel in the storage unit. Once the sensor signal reading circuit 26 has finished reading data from a row, it starts reading data from the next row. This operation is repeated and, thus, photosensor signals (read data) are read from the entire plane sensor during the information gathering period. Using the drive method described above, this device serves as an information gathering device based on light detection during an information gathering period.

Incidentally, if strong light is applied to a pixel and therefore the corresponding first transistor 40 generates a large off current, the potential of the corresponding pixel electrode is shifted from that of the reference power supply set up by the image maintenance operation. To avoid this happening, it is preferable that the on resistance of the second transistor 42 be sufficiently smaller than the off resistance of the first transistor 40 at the time when strong light is applied to the first transistor 40. The channel width and channel length of the first transistor 40, the channel width and channel length of the second transistor 42, and the potential of the selected second scan line 12 (gate potential that puts the second transistor in an on state) are set up so that the off resistance of the first transistor 40 at the time when strong light is applied to the first transistor 40 becomes 100 times or higher the on resistance of the second transistor 42. This prevents disturbance of the image during an information gathering period.

If a user uses a pen-shaped light emitting device as the input device, the control unit 28 determines to what position (that is, the position of the pen tip) on the functional plane (the outer plane of the first substrate 60) the user has touched the pen-shaped light emitting device, on the basis of the read data. FIG. 14-(2) shows a pen position identified by the plane sensor during the k-th information gathering period as an example. The control unit 28 is able to reflect the detection result of the pen tip position obtained in this manner on a subsequent information process. For example, if the displayed image includes a page forward button for proceeding to the next page and if a user touches the pen-shaped light emitting device to the button, the control unit 28 performs a process for changing the displayed image to an image on the next page. If an electrooptic device 1 according to this embodiment is incorporated into various electronic apparatuses, the control unit 28 is able to pass the position detection result on to a higher-order control unit, thereby allowing the contents of the instruction provided by the user to be reflected on a subsequent process to be performed by the higher-order control unit. As a specific example of an aspect in which the contents of an instruction provided by a user are reflected on a subsequent information process, as described above, a method for overwriting an image with the contents of a handwritten input will be simply described below.

Based on the read data acquired from the sensor signal reading circuit 26 and stored in the storage unit 30 during the k-th information gathering period, the control unit 28 identifies the position of the pen-shaped light emitting device on the functional plane (screen) (FIG. 14-(2)). Then, using information on the identified position of the pen-shaped light emitting device, the control unit 28 creates information on a written image with which information on the previously (k-th) displayed image is to be overwritten during the next (k+1)-th image display period. Information on a written image refers to information for display that reflects information inputted from the functional plane, and will be displayed during the next image display period. Specifically, it corresponds to what has been written using the pen-shaped light emitting device. In FIG. 14-(3), write image information to be displayed during the (k+1)-th image display period is depicted and a pixel corresponding to the position of the pen-shaped light emitting device is displayed in black. Then, the control unit 28 overwrites (k+1)-th display image information (FIG. 14-(5); in this case, k-th display image information is the same as the (k+1)-th display image information) stored in storage unit 30, with the above-mentioned (k+1)-th write image information to create an image to be displayed during the (k+1)-th image display period (FIG. 14-(4)) and displays the created image during that period. Thus, the pixels displayed in black on the previous screen (display image information for the k-th image display period) and a pixel (write image information for the (k+1)-th image display period) corresponding to the position where a new writing has been made using the pen-shaped light emitting device are displayed in black. Thus, an image in which the image displayed on the previous screen is overwritten with the image written by the user is obtained.

Upon completion of the (k+1)-th image display period, a (k+1)-th information gathering period starts. As in the previous information gathering period, the position of the pen-shaped light emitting device is identified during this period (FIG. 14-(6)). Based on this position information, the control unit 28 creates write image information for the next (k+2)-th image display period (FIG. 14-(7)). Since the position of the pen-shaped light emitting device has moved in a period between the (k+1)-th image display period and the (k+2)-th image display period in this example, the write image information for the (k+2)-th image display period takes the shape of a line (FIG. 14-(7)). By combining the (k+2)-th write image information obtained in this manner and (k+2)-th display image information (FIG. 14-(9); in this case, (k+1)-th display image information is the same as the (k+2)-th display image information), the control unit 28 creates an image to be displayed during the (k+2)-th image display period (FIG. 14-(8)) and displays the created image during that period. Similarly, an image display period and an information gathering period are repeated alternately. In this way, inputting of handwriting to the functional plane proceeds.

Figure 15A:
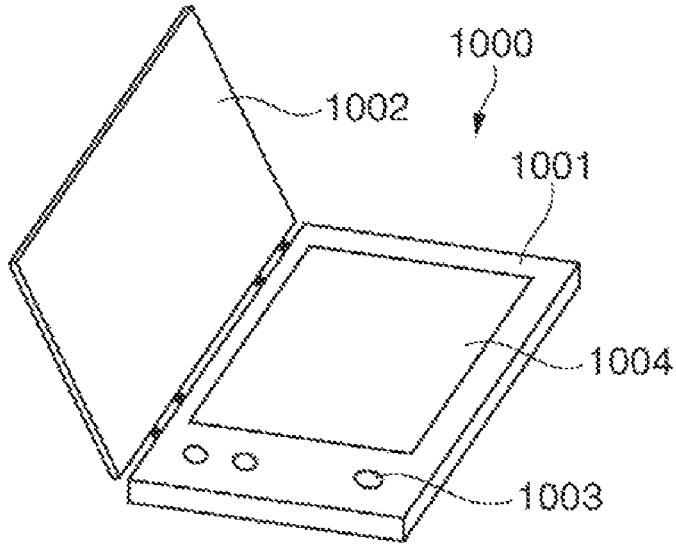
FIG. 15A is a schematic perspective view illustrating an electronic apparatus.
Figure 15B:
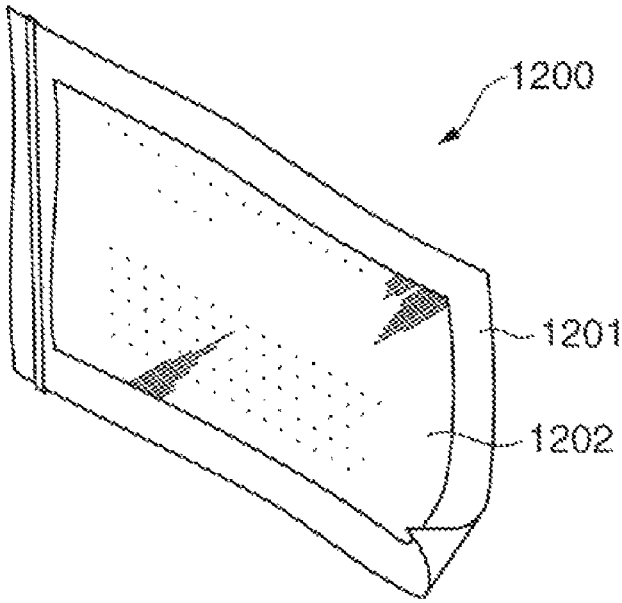
FIG. 15B is a schematic perspective view illustrating an electronic apparatus.

FIGS. 15A and 15B are perspective views showing specific examples of an electronic apparatus using the electrooptic device according to this embodiment. FIG. 15A is a perspective view showing a so-called electronic book. An electronic book 1000 includes a book-shaped frame 1001, a cover 1002 provided so as to freely rotate (open/close) with respect to the frame 1001, an operation unit 1003, and a display 1004 including the electrooptic device according to this embodiment. FIG. 15B is a perspective view showing so-called electronic paper. Electronic paper 1200 includes a main body 1201 including a rewritable sheet having textures and flexibility similar to those of paper and a display 1202 including the electrooptic device according to this embodiment. Electronic apparatuses to which the electrooptic device according to this embodiment is applicable are not limited to these apparatuses. Such electronic apparatuses include apparatuses that utilize a change in color tone made when charged particles move. For example, in addition to the above-mentioned apparatuses, electronic apparatuses mounted on static objects such as walls and those mounted on moving objects such as automobiles, airplanes, and ships correspond to such electronic apparatuses.

As described above, in the electrooptic device according to this embodiment, the second transistors 42 are scanned and sequentially put in an on state when the first transistors are put in an off state. Then, relatively string light is applied to the first transistors in this state using the pen-shaped light emitting device to generate or increase an off current. Then, detecting such off currents via the signal lines allows the first transistor having a large off current to be identified. The position specified on the screen is detected on the basis of the position of the first transistor having a large off current. As can be seen, according to the configuration simpler than those of related-art examples, an electrooptic device that allows detection of a position on the screen is realized. In addition, according to such a configuration, light is applied to the first transistors from the transparent first substrate side. At this time, the light shielding film prevents light from entering the second transistors, thereby making it easier to control operations of the second transistors. Further, using a transparent conductive film as the pixel electrode in contact with the circuit layer (that is, above the first substrate) allows the display state of the electrooptic element to be recognized from the pixel electrode side.

The invention is not limited to the above-mentioned embodiment and various modifications can be made thereto within the spirit and scope of the invention. For example, the charged state and coloring state (white, black) of the electrophoretic particles described above are only illustrative and does not limit the invention. The numeric values such as voltages are specific examples and does not limit the invention.

Further, in the above-mentioned embodiment, an electrophoretic display has been employed as an example of an electrooptic device; however, the applicable range of the invention is not limited to this. Replacing the electrooptic element according to this embodiment with a liquid crystal element allows a liquid crystal device serving as an embodiment of the invention to be obtained. Likewise, replacing the electrooptic element with an electrochromic element allows an electrochromic device serving as an embodiment of the invention to be obtained.

Embodiment

Figure 6:
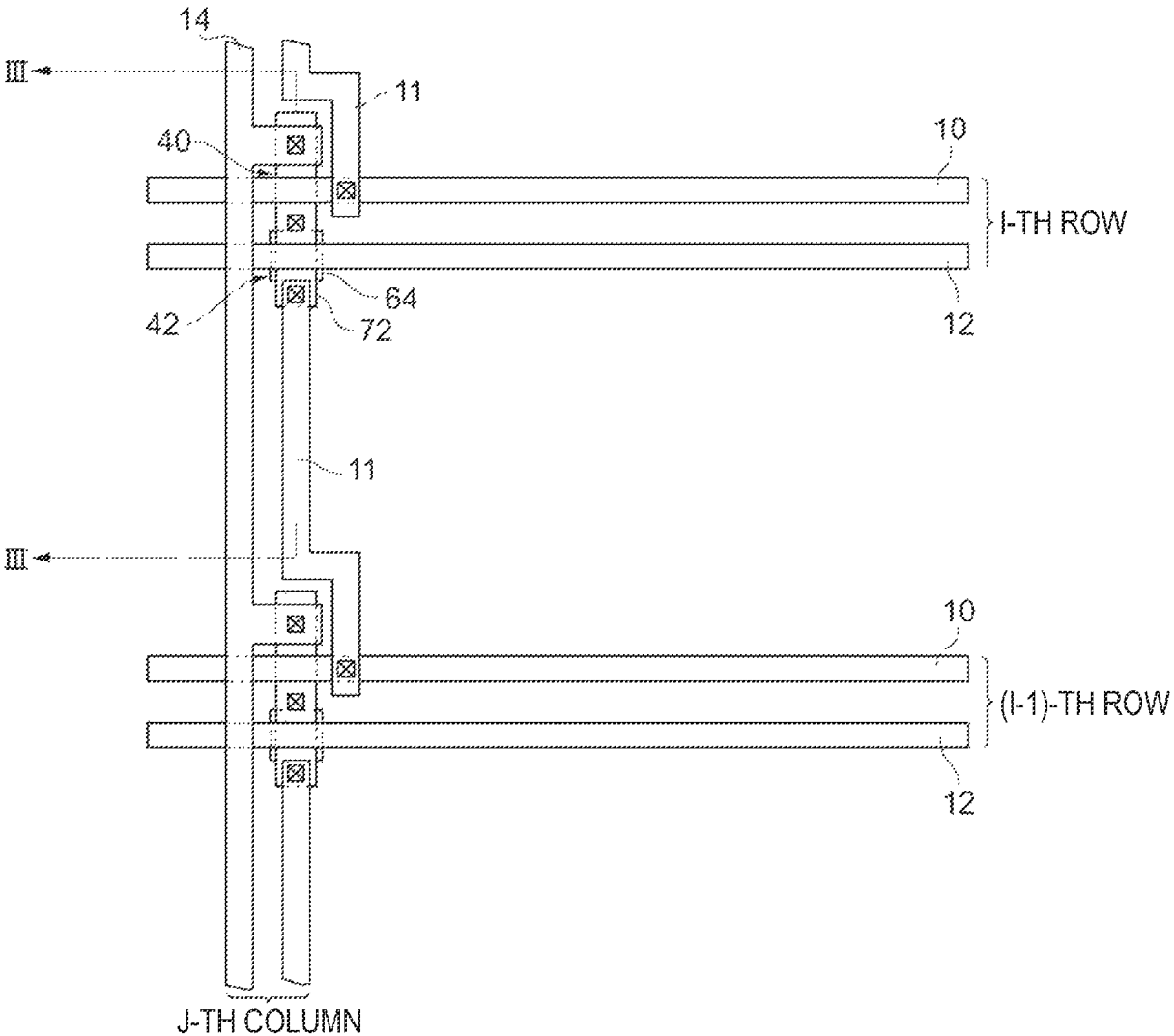
FIG. 6 is a plan view showing a wiring configuration of a pixel.
Figure 7:
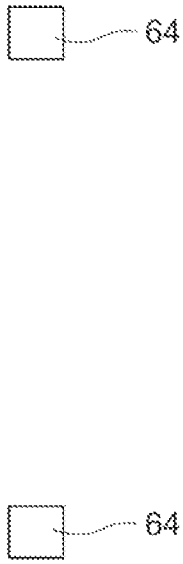
FIG. 7 is a plan view showing a process step of forming wiring and the like of a pixel.
Figure 8:
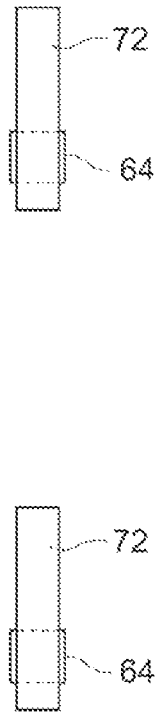
FIG. 8 is a plan view showing a process step of forming wiring and the like of the pixel.
Figure 11:
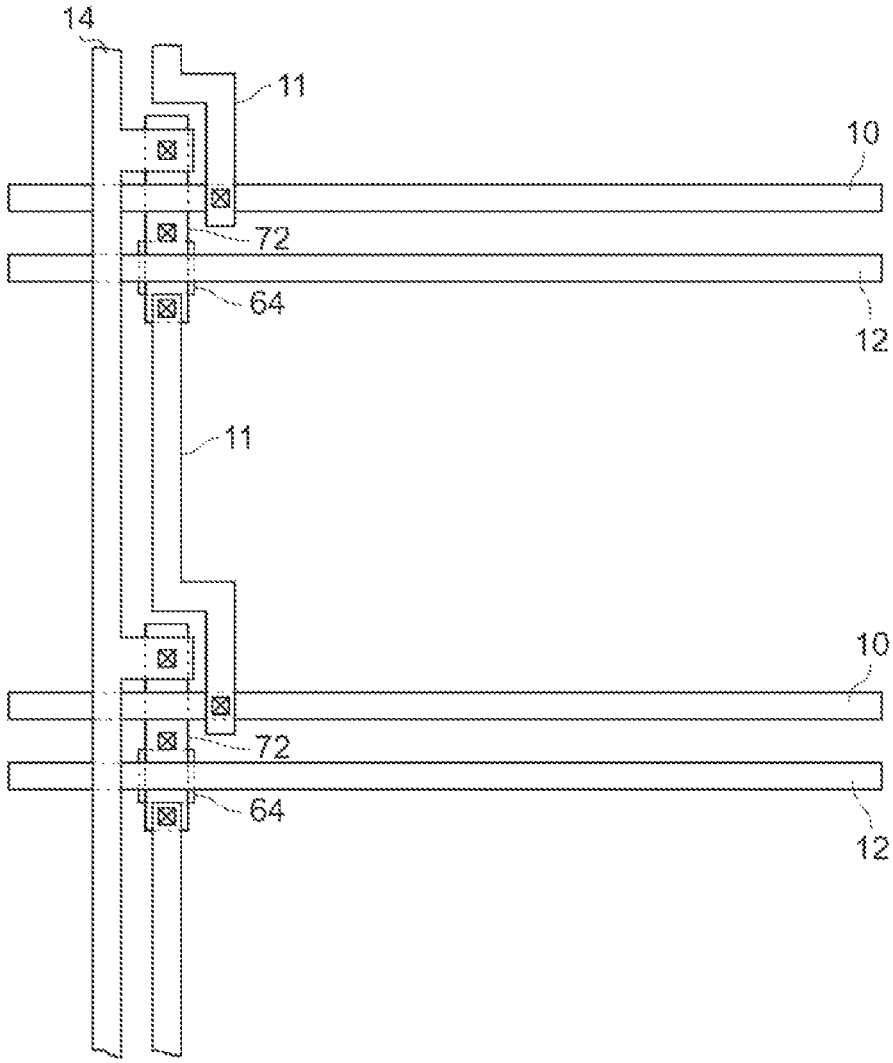
FIG. 11 is a plan view showing a process step of forming wiring and the like of the pixel.

FIG. 6 is an example of a plan view showing a wiring configuration of a pixel. The sectional view shown in FIG. 5 is approximately a sectional view taken along line III-III of FIG. 6. As illustrated, the light shielding film 64 is provided below the semiconductor film 72 and in a position that overlaps a portion constituting the second transistor 42, of the semiconductor film 72, more specifically, in a position that overlaps at least the channel forming area of the second transistor 42. The semiconductor film 72 is shared by the first and second transistors 40 and 42. Provided above the semiconductor film 72 are the first and second scan lines 10 and 12. Provided above the first and second scan lines 10 and 12 are the signal line 14 and the wiring 11. As illustrated, the wiring 11 is coupled to the semiconductor film 72 (a portion corresponding to the second transistor 42) via a contact hole and coupled to the first scan line 10 in the (i−1)-th row. FIGS. 7 to 11 show process steps of forming this wiring and the like. Referring now to these drawings, the process steps will simply be described. Note that the transparent electrode, and the insulating films between the wiring and the like will not be described. First, the light shielding film 64 is formed in a predetermined position on the first substrate 60 (FIG. 7). Subsequently, the semiconductor film 72 is formed in a position where a part of the semiconductor film 72 overlaps the light shielding film 64 (FIG. 8). The semiconductor film 72 is obtained by forming a polysilicon film and patterning the polysilicon film into the form of an island. Subsequently, the first and second scan lines 10 and 12 are formed above the semiconductor film 72 (FIG. 9). These scan lines are obtained by forming conductive films made of aluminum and then patterning the conductive films (FIG. 10). Thereafter, contact holes are made in predetermined positions of an insulating film (not shown) (FIG. 10). Then, the signal line 14 and wiring 11 are formed above the semiconductor film 72 (FIG. 11). These are obtained by forming conductive films made of aluminum and then patterning the conductive films.

An example configuration of a pen-shaped light emitting device suitable for the electrooptic device 1 according to this device will now be described. A pen-shaped light emitting device here refers to a device that has a shape similar to that of an ordinary pen and that is configured so that strong light is emitted from an end thereof. A device for inputting handwriting to this device is not limited to this and any lighting device that is small in size and emits strong light is applicable.

Figure 12:
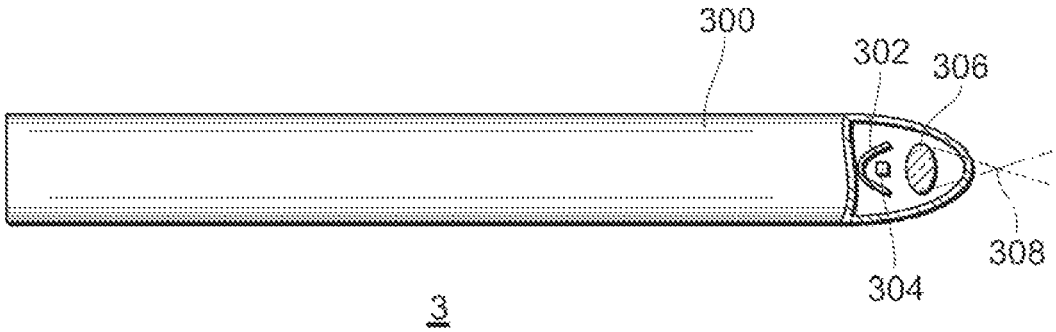
FIG. 12 is a schematic view showing an example configuration of a pen-shaped light emitting device.

FIG. 12 is a schematic view showing an example configuration of the pen-shaped light emitting device. In FIG. 12, the pen-shaped light emitting device is shown in a plan view and a tip thereof is partially shown in section. An illustrated pen-shaped light emitting device 3 includes a reflection mirror 302, a light emitting diode (LED) light source 304, and a lens 306 at one end of a main body 300. Light emitted from the LED light source 304 enters the lens 306 directly as well as enters there as reflection light from the reflection mirror 302. This incident light is brought into a focal point 308 by the lens 306, and then diverges. The LED light source 304 is illustrative only and other types of light source may be used. According to the pen-shaped light emitting device 3 as described above, high illumination light that is brought into the focal point 308 is applied to the surface of the first substrate 60 of the electrooptic device 1.

Conditions for allowing writing using the pen-shaped light emitting device 3 regardless of variations in sunlight illumination due to the weather of the outside world, such as rain or fine weather, will be considered below. The illumination of sunlight is approximately 2000 lux in a rainy day or a cloudy day and is approximately 100 thousand lux in fine weather. The amount of the off current of a thin film transistor is in proportion to the amount of application of light. For 0 lux, the off current is 1 pA (picoampere); for 10000 lux, the off current is on the order of 10 pA; and under sunlight in fine weather (illumination of 100 thousand lux), the off current is about 100 pA. If a currently available high illumination LED is used, the illumination of light with a beam diameter of 10 mm is on the order of 100 thousand lux. Therefore, if the beam diameter is narrowed to 1 mm by the lens 306, the illumination at the focal point 308 becomes approximately 10 million lux. In other words, an illumination that is 100 times that of sunlight in fine weather is obtained at the focal point 308. The off current of a thin film transistor with respect to this light illumination at focal point 308 becomes approximately 10000 pA. This is a value sufficient to determine whether light has been applied. The light emitting part of an LED light source is typically 0.2 mm×0.2 mm in size, so light can be gathered up to this size by the lens 306. The illumination of light with this size easily exceeds 100 million lux and is 1000 times or higher that of sunlight in fine weather. Accordingly, the off current of a thin film transistor becomes 1000 times or more. This allows writing using the pen-shaped light emitting device 3 even in fine weather.

Figure 13:
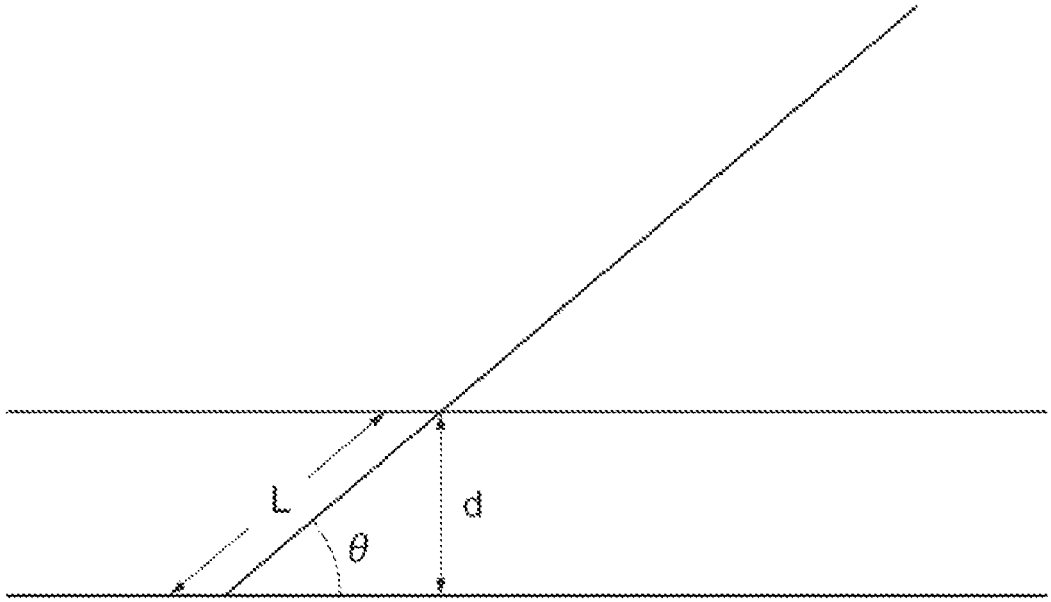
FIG. 13 is a diagram showing a preferred range of the distance from the pen tip of the pen-shaped light emitting device to a focal point.

Referring now to FIG. 13, the preferred range of the distance from the pen tip of the pen-shaped light emitting device 3 to the focal point 308 will be described. The distance L from the pen tip to a thin film transistor shown in the drawing is obtained by the following equation.

$$L = d\sqrt{\frac{1}{\tan^2\theta} + 1} \quad \text{Equation 1}$$

where L is the distance from the pen tip to the focal point 308, d is the thickness of the first substrate 60, and θ is an angle formed when a human naturally have a pen.

If the range 60 to 80 of the angle θ is substituted into Equation 1, the preferred range of the distance L is obtained as $1.015d \leqq L \leqq 1.155d$. Therefore, the lens 306 such that the focal distance falls within this range is preferably used.

Technical Concept

Many of electronic apparatuses that can substitute for a traditional paper medium, such as so-called electronic paper and electronic books, use an electrophoretic device as the display thereof. For example, such related-art electrophoretic devices are disclosed in JP-A-2005-24864, JP-A-2005-283820, JP-A-2005-84343, etc. However, related-art electronic paper and the like is intended to display an image on the basis of data (e.g., image data such as a book or a photo) previously stored in a memory. In other words, electronic paper and the like has been only used for display, so it has been difficult to configure electronic paper such that a user is allowed to perform a process such as freely writing a memo or an underline into a displayed image or specifying a desired position in an image.

For example, it is conceivable to provide a touch sensor on the display surface of electronic paper or the like; however, in this case, the configuration is complicated and there is room for further improvement in terms of reductions in size, such as thickness, and weight. This problem is faced not only by electrophoretic devices but also by electrooptic devices having a similar application, such as liquid crystal devices and electrochromic devices. Therefore, there are desired an electrooptic device that allows detection of a specified position on the screen while having a simpler configuration, and an electronic apparatus including such an electrooptic device.

An electrooptic device according to the invention includes a plurality of first scan lines, a plurality of second scan lines that are the same in number as the first scan lines and disposed in parallel to the first scan lines, a plurality of signal lines disposed so as to intersect the first scan lines and the second scan lines, and a plurality of pixels disposed at intersections of the first scan lines and the second scan lines and the signal lines so as to be in a matrix form. Each pixel located in an i-th row and a j-th column (i and j are both natural numbers) includes a first transistor, a second transistor, and a pixel electrode. A gate of the first transistor is coupled to the first scan line in the i-th row. One of a source and a drain of the first transistor is coupled to the signal line on the j-th column. A gate of the second transistor is coupled to the second scan line in the i-th row. One of a source and a drain of the second transistor is coupled to the other of the source and drain of the first transistor. The other of the source and drain of the first transistor is coupled to the pixel electrode.

According to this configuration, when the first transistors are put in an off state, the second transistors are scanned and sequentially put in an on state. In this state, relatively strong light is applied to the first transistors using a pen-shaped device that is able to emit light from an end thereof, so that an off current is generated or increased. Then the off current is detected via the signal line to recognize a first transistor having a large off current. On the basis of the position of this first transistor having an large off current, the position specified on the screen is detected. That is, according to the invention, an electrooptic device that has a configuration for position detection in a panel thereof is realized. In addition, this electrooptic device is realized in a configuration simpler than those of related-art examples.

In the above-mentioned electrooptic device, the other of the source and drain of the second transistor is preferably coupled to the first scan line in the (i−1)-th row.

In the above-mentioned electrooptic device, the other of the source and drain of the second transistor is preferably coupled to the first scan line in an (i−1)-th row.

This allows a reduction in number of the signal lines.

In the above-mentioned electrooptic device, the pixels each preferably include the pixel electrode, a common electrode, and an electrooptic material interposed therebetween. An "electrooptic material" here refers to a material that causes a change in optical state due to an electrical stimulus (voltage, current, etc.) from the outside world. Among such electrooptic materials are electrooptic devices, liquid crystal materials, and electrochromic materials.

Thus, an electrooptic device, a liquid crystal device, or an electrochromic device that has a configuration for position detection in a panel thereof is obtained.

The above-mentioned electrooptic device preferably further includes a holding capacitance coupled between the other of the source and drain of the first transistor and the first scan line in the (i−1)-th row.

This allows an increase in display contrast. In addition, coupling the other of the source and drain of each first transistor to each first scan line allows an increase in aperture ratio of each pixel.

The above-mentioned electrooptic device preferably includes a first substrate and a second substrate. The first substrate is preferably transparent. The first scan lines, the second scan lines, the signal lines, the first transistors, and the second transistors are preferably disposed on the first substrate so as to constitute a circuit layer. The pixel electrodes are preferably formed on the circuit layer using a transparent conductive film. A light shielding film is preferably disposed between the first substrate and the second transistor. The common electrode is preferably formed on the second substrate. The electrooptic material is preferably interposed between the first and second substrates.

According to this configuration, light is applied from the transparent first substrate side to the first transistors. At this time, the light shielding film prevents light from entering the second transistors, thereby making it easier to control operations of the second transistors. In addition, using a transparent conductive film as the pixel electrodes that are in contact with the circuit layer (that is, adjacent to the first substrate) allows the display state of the electrophoretic element to be visually recognized from the pixel electrode side.

In the above-mentioned electrooptic device, the holding capacitance is preferably included in the circuit layer.

The holding capacitance preferably includes the pixel electrode, a holding capacitance electrode, and a holding capacitance dielectric film interposed therebetween. The pixel electrode, the holding capacitance electrode, and the holding capacitance dielectric film are preferably all transparent.

Thus, the display of an image is visually recognized from the first substrate side in an improved manner.

In the above-mentioned electrooptic device, the light shielding film is preferably provided in a position that overlaps an active area of the second transistor. An "active area" here refers to an area including a channel forming area, a drain area adjacent to the channel forming area, and a source area adjacent to the channel forming area. The light shielding film is preferably provided in a position that does not overlap an active region of the first transistor.

At least preventing light from entering the active area avoids giving a negative effect to the second transistors to a certain extent.

The above-mentioned electrooptic device preferably includes a first scan driver coupled to the first scan lines, a second scan driver coupled to the second scan lines, a signal line driver coupled to first ends of the signal lines, a switching circuit coupled between the signal lines and the signal line driver for switching between continuity and discontinuity between the signal lines and the signal line driver, and a sense amplifier coupled to second ends of the signal lines.

According to this configuration, the electrooptic device realizes both control over detection of a position on the screen and control over display of an image by the electrophoretic element while having a relatively simple configuration.

The above-mentioned electrooptic device preferably further includes a control unit for providing a control signal to each of the first scan driver, the second scan driver, the signal line driver, the switching circuit, and the sense amplifier, and a storage unit coupled to the control unit. The control unit preferably stores data read by the sensor amplifier in the storage unit.

Performing information processing by the control unit using the read data stored in the storage unit allows identification of a position specified on the screen, thereby reflecting the identified position on a subsequent process. In addition, operations of the drivers, the switching circuit, and the sense amplifier are controlled by the control unit in a unified way.

In a preferable aspect of information processing using the read data, the control unit updates image data stored in the storage unit on the basis of the read data and provides a control signal in accordance with the image data to the signal line driver.

Thus, the current image is overwritten with an image in accordance with the detection result of a position on the screen.

In a more preferable aspect, the above-mentioned electrooptic device further includes an input unit coupled to the control unit. When a predetermined operation instruction is inputted using the input unit, the control unit controls the switching circuit to provide discontinuity between the signal lines and the signal line driver, thereby operating the sense amplifier.

Thus, image display mode and handwriting input mode (for example, mode in which an image is written as described above) are switched according to an operation instruction made using the input unit.

The electrooptic device according to the invention as described above is preferably used as the display of so-called electronic paper, an electronic book, or the like.

Thus, an electronic book or the like that has both a display function of an electrooptic device and a function for inputting an instruction onto the screen while having a simpler configuration is realized.

What is claimed is:

1. An electrooptic device having an image display period and an information gathering period, comprising:

a panel unit including:

a first substrate;

a second substrate;

an electrooptic material interposed between the first and second substrates;

a plurality of first scan lines provided above the first substrate;

a plurality of second scan lines provided above the first substrate and disposed in parallel to the first scan lines;

a plurality of signal lines provided above the first substrate and intersecting the first scan lines and the second scan lines; and a plurality of pixels provided above the first substrate and disposed at intersections of the first scan lines and the second scan lines and the signal lines, each pixel located in an i-th row and a j-th column, the i and the j being both natural numbers, including:

a first transistor;

a second transistor; and a pixel electrode; and a data processing unit, wherein:

the plurality of pixels are formed in a matrix on the first substrate;

a gate of the first transistor is connected to the first scan line in the i-th row;

one of a source and a drain of the first transistor is connected to the signal line on the j-th column;

a gate of the second transistor is connected to the second scan line in the i-th row;

one of a source and a drain of the second transistor is connected to the other of the source and drain of the first transistor; and the other of the source and drain of the first transistor is connected to the pixel electrode.

2. The electrooptic device according to claim 1, wherein the other of the source and drain of the second transistor is coupled to a reference power supply.

3. The electrooptic device according to claim 1, wherein the other of the source and drain of the second transistor is coupled to the first scan line in an (i−1)-th row.

4. The electrooptic device according to claim 2, wherein the panel unit further includes a holding capacitance provided between the other of the source and drain of the first transistor and the reference power supply.

5. The electrooptic device according to claim 3, wherein the panel unit further includes a holding capacitance provided between the other of the source and drain of the first transistor and the reference power supply and the first scan line in the (i−1)-th row.

6. The electrooptic device according to claim 1, wherein:

the panel unit further includes:

a common electrode disposed on the second substrate; and a light shielding film disposed between the first substrate and the second transistor;

the first substrate is transparent; and the pixel electrode is formed of a transparent conductive film.

7. The electrooptic device according to claim 4, wherein:

the panel unit further includes:

a common electrode disposed on the second substrate; and a light shielding film disposed between the first substrate and the second transistor;

the first substrate is transparent;

the pixel electrode is formed of a transparent conductive film;

the holding capacitance includes:

a holding capacitance first electrode;

a holing capacitance second electrode; and a holding capacitance dielectric film interposed between the holding capacitance first and second electrodes; and the holding capacitance first and second electrodes and the holding capacitance dielectric film are all transparent.

8. The electrooptic device according to claim 7, wherein the pixel electrode is the holding capacitance second electrode.

9. The electrooptic device according to claim 6, wherein the light shielding film is provided in a position that overlaps an active region of the second transistor.

10. The electrooptic device according to claim 6, wherein the light shielding film is provided in a position that does not overlap an active region of the first transistor.

11. The electrooptic device according to claim 1, wherein the panel unit further includes:

a first scan selection circuit coupled to the first scan lines and serving to select a particular one from among the plurality of first scan lines;

a second scan selection circuit coupled to the second scan lines and serving to select a particular one from among the plurality of second scan lines;

a display signal providing circuit coupled to first ends of the signal lines and serving to supply a display signal to each signal line, the display signal being unique to each signal line; and a sensor signal reading circuit coupled to second ends of the signal lines and serving to read a sensor signal outputted from each signal line, the sensor signal being unique to each signal line; and the first scan selection circuit, the second scan selection circuit, the display signal providing circuit, and the sensor signal reading circuit are disposed on the first substrate.

12. The electrooptic device according to claim 11, wherein: the data processing unit includes:

an input unit;

a control unit; and a storage unit;

the input unit serves to supply display image information inputted from outside to the control unit or the storage unit;

the control unit serves to control at least the first scan selection circuit, the second scan selection circuit, the display signal providing circuit, the sensor signal reading circuit, and the storage unit; and the storage unit serves to store the display image information and write image information based on the sensor signal.

13. The electrooptic device according to claim 12, wherein the control unit serves to create an new display image using the display image information and the write image information and to supply the new display image as a new display signal to the display signal providing circuit.

14. The electrooptic device according to claim 11, wherein the panel unit further includes a switching circuit disposed between the signal lines and the display signal providing circuit, the switching circuit switching between continuity and discontinuity between the signal lines and the display signal providing circuit.

15. The electrooptic device according to claim 14, wherein: the switching circuit provides continuity between the signal lines and the display signal providing circuit during the image display period; and the switching circuit provides discontinuity between the signal lines and the display signal providing circuit during the information gathering period.

16. The electrooptic device according to claim 1, wherein the electrooptic material is an electrophoretic material.

17. The electrooptic device according to claim 1, wherein the electrooptic material is a liquid crystal material.

18. The electrooptic device according to claim 1, wherein the electrooptic material is an electrochromic material.

19. An electronic apparatus comprising the electrooptic device according to claim 1.

* * * * *